US011724501B2

(12) United States Patent
Yoda et al.

(10) Patent No.: US 11,724,501 B2
(45) Date of Patent: Aug. 15, 2023

(54) INK-JET HEAD

(71) Applicant: KYOCERA Document Solutions Inc., Osaka (JP)

(72) Inventors: Junya Yoda, Osaka (JP); Junichi Fukuoka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 15 days.

(21) Appl. No.: 17/710,347

(22) Filed: Mar. 31, 2022

(65) Prior Publication Data

US 2022/0339937 A1 Oct. 27, 2022

(30) Foreign Application Priority Data

Apr. 26, 2021 (JP) ..... 2021-074069

(51) Int. Cl.
*B41J 2/14* (2006.01)
*B41J 2/045* (2006.01)

(52) U.S. Cl.
CPC ..... *B41J 2/1433* (2013.01); *B41J 2/04563* (2013.01)

(58) Field of Classification Search
CPC .. B41J 2/1433; B41J 2/04563; B41J 2/04581; B41J 2202/08; B41J 2/14233; B41J 2/04531; B41J 2/04538; B41J 2/0454; B41J 2/04553; B41J 2/04565
See application file for complete search history.

(56) References Cited

U.S. PATENT DOCUMENTS 6,409,316 B1 * 6/2002 Clark ..... B41J 2/1631 347/63
2006/0092203 A1 * 5/2006 Drake ..... B41J 2/2132 347/12
2020/0031119 A1 * 1/2020 Bush ..... B41J 2/04573

FOREIGN PATENT DOCUMENTS

JP 2017-217823 A 12/2017

* cited by examiner

*Primary Examiner* — Kristal Feggins
(74) *Attorney, Agent, or Firm* — Stein IP, LLC

(57) ABSTRACT

Provided is an ink-jet head including: a back end portion; a front end portion which ejects the ink; a heating plate which is arranged between the back end portion and the front end portion, and which heats the back end portion and the front end portion; and a temperature detection device which is provided on the heating plate, and which outputs a value in accordance with a temperature of the front end portion, the temperature detection device being held in direct contact with the front end portion.

6 Claims, 10 Drawing Sheets

INK-JET HEAD

INCORPORATION BY REFERENCE

This application is based on and claims the benefit of priority from Japanese Patent Application No. 2021-074069 filed on Apr. 26, 2021, the contents of which are hereby incorporated by reference.

BACKGROUND

The present disclosure relates to ink-jet heads that eject inks.

Image forming apparatuses of an ink-jet type include heads. The heads each include nozzles, and inks are ejected through the nozzles. Viscosity of the inks varies depending on temperatures of the inks. For example, in a case where the temperatures of the inks are low in the heads, amounts of the inks to be ejected are deficient. As a countermeasure, the heads are provided with heaters that heat the inks.

SUMMARY

According to an aspect of the present disclosure, there is provided an ink-jet head including: a back end portion; a front end portion; a heating plate; and a temperature detection device. An ink is fed into the back end portion. The front end portion includes a nozzle, receives the ink supplied from the back end portion, and ejects the ink through the nozzle. The heating plate is a plate-like member on which a heating element that generates heat by energization is arranged, is arranged between the back end portion and the front end portion, and heats the back end portion and the front end portion with the heat generated by the heating element. The temperature detection device is provided on the heating plate, and outputs a value in accordance with a temperature of the front end portion. The temperature detection device is held in direct contact with the front end portion.

DETAILED DESCRIPTION

Hereinbelow, with reference to FIG. 1 to FIG. 10, inkjet heads 100 according to an embodiment of the present disclosure, and an image forming apparatus including the inkjet heads 100 are described. The ink-jet heads 100 each include a plurality of nozzles 5, and eject inks onto sheets through the nozzles 5 at a time of image formation.

The following description is made by way of an example of a printer 101 as the image forming apparatus, but the present disclosure is applicable also to other image-forming apparatuses such as a multifunction peripheral.

In addition, in the following description, a three-dimensional rectangular coordinate system (X-Y-Z coordinate system) is used. Note that, an X-axis direction is a main scanning direction. The main scanning direction is a direction in which the nozzles 5 are arrayed. A Y-axis direction is a sub-scanning direction. The sub-scanning direction is a direction orthogonal to the X-axis direction. The Y-axis direction is also a direction in which the sheets are conveyed relative to the ink-jet heads 100. A Z-axis direction is a direction orthogonal to the X-axis direction and the Y-axis direction. The Z-axis direction is also a direction in which the nozzles 5 and recording surfaces of the sheets to be conveyed (surfaces onto which the inks are ejected) face each other. A plane including the X-axis and the Y-axis is parallel, for example, to a horizontal plane. In this case, the Z-axis direction corresponds to a vertical direction (upward-and-downward direction).

The X-axis, the Y-axis, and the Z-axis directions are shown in some of drawings to be referred to in the following description. In the following description and the drawings, a +X direction is one side in the X-axis direction. A −X direction is another side in the X-axis direction. A +Y direction is one side in the Y-axis direction, and is an upstream side in the sheet conveying direction. A −Y direction is another side in the Y-axis direction, and is a downstream side in the sheet conveying direction. A +Z direction is one side in the Z-axis direction. Under a state in which the printer 101 is installed in the horizontal plane, the +Z direction corresponds to the upward direction. A −Z direction is another side in the Z-axis direction. Under the state in which the printer 101 is installed in the horizontal plane, the −Z direction corresponds to the downward direction.

Note that, the word "vertical" encompasses meaning of "substantially vertical." In addition, a word "perpendicular" encompasses meaning of "substantially perpendicular." These directions are defined for the sake of convenience of description. These directions are not intended to limit orientations of the ink-jet heads 100 during manufacture and use.

(Overview of Printer 101)

Figure 1:
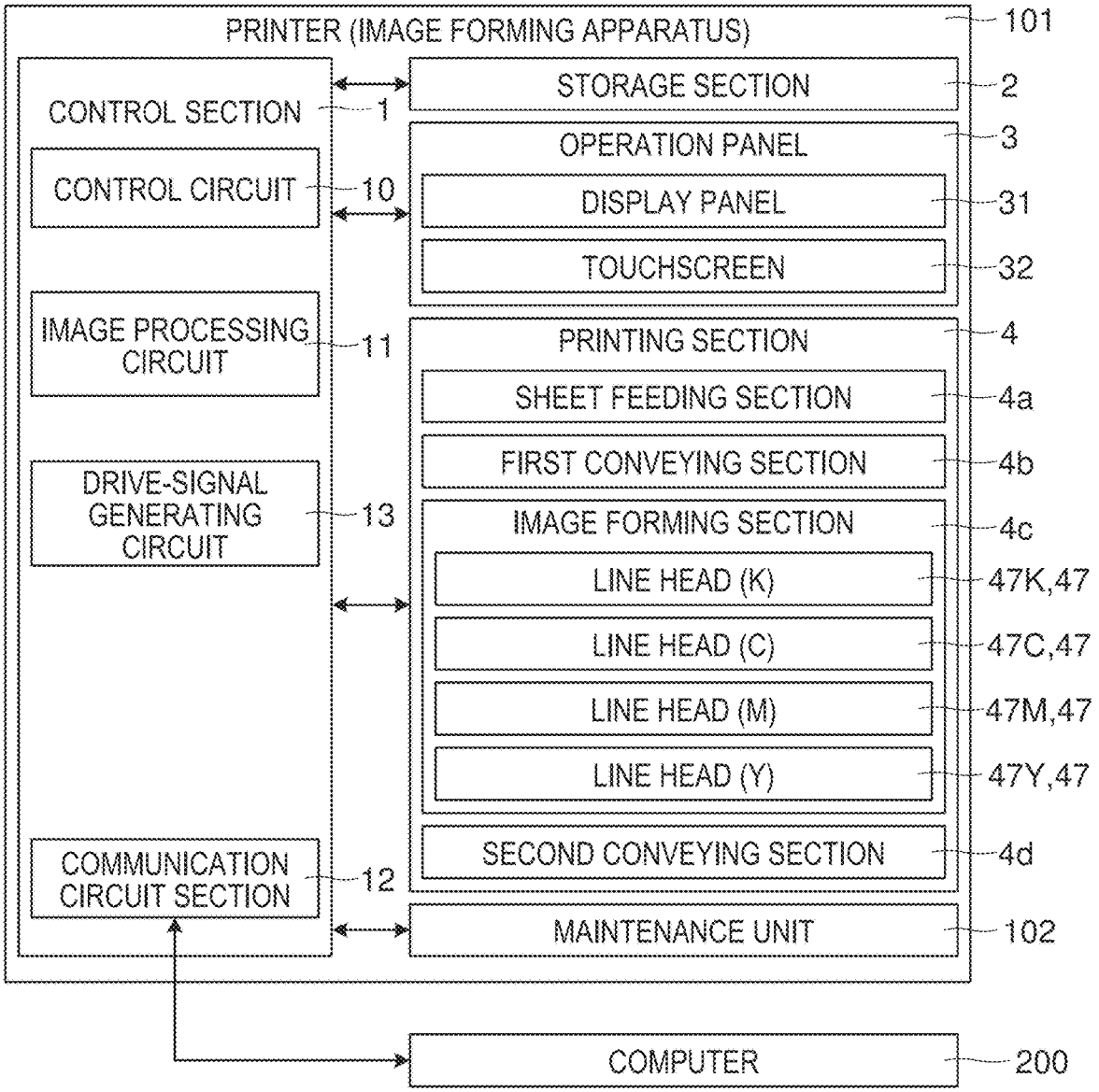
FIG. 1 is a block diagram of a printer including inkjet heads according to an embodiment of the present disclosure.
Figure 2:
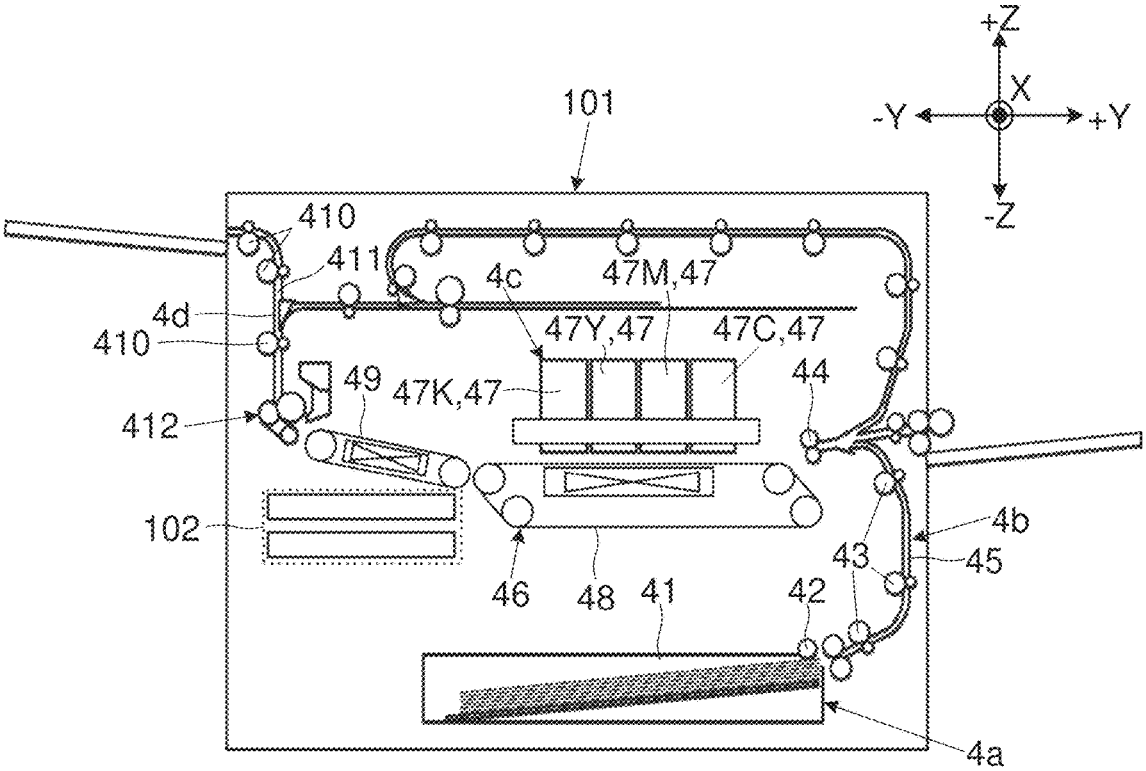
FIG. 2 is an overall schematic view of the printer including the ink jet heads according to the embodiment.

As shown in FIG. 1 and FIG. 2, the printer 101 includes a control section 1, a storage section 2, an operation panel 3, a printing section 4, and a maintenance unit 102. The control section 1 controls the sections in the printer 101. The control section 1 includes a control circuit 10 and an image processing circuit 11. The control circuit 10 is a CPU. The control circuit 10 executes computations and processes in accordance with control programs and control data. The image processing circuit 11 generates image data for ink ejection. The storage section 2 includes a ROM, a storage, and a RAM. An HDD and an SSD may be used as the storage. The storage section 2 stores the control programs and the control data.

The control section 1 includes a communication circuit section 12. The communication circuit section 12 is communicably connected to a computer 200. The control section 1 receives print data from the computer 200 via the communication circuit section 12. The print data includes setting data of print jobs and data describing contents to be printed.

The control section 1 generates image data in accordance with the print data, and executes image processing on the generated image data. In this way, the control section 1 generates the image data for ink ejection.

The operation panel 3 includes a display panel 31 and a touchscreen 32. The control section 1 causes the display panel 31 to display a setting screen. The display panel 31 displays operation images such as images of keys, buttons, and tabs. The touchscreen 32 detects touch operations to the display panel 31. On the basis of output from the touchscreen 32, the control section 1 recognizes operation images operated by a user among the operation images. The control section 1 recognizes settings made by the user.

The printing section 4 includes a sheet feeding section 4*a*, a first conveying section 4*b*, an image forming section 4*c*, and a second conveying section 4*d*. In the print job, the control section 1 controls operations of the printing section 4.

The sheet feeding section 4*a* includes a sheet feeding cassette 41 and a sheet feeding roller 42. The sheet feeding cassette 41 houses recording media. The recording media are, for example, the sheets. Note that, the printer 101 is capable of printing on recording media other than the sheets. In this case, the sheet feeding cassette 41 houses the recording media other than the sheets.

The sheet feeding roller 42 comes into contact with the sheets in the sheet feeding cassette 41. In the print job, the sheet feeding roller 42 rotates to send out the sheets from the sheet feeding cassette 41.

The first conveying section 4*b* conveys, to the image forming section 4*c*, the sheets sent out from the sheet feeding cassette 41. The first conveying section 4*b* includes a plurality of first roller pairs 43 and a registration roller pair 44. In addition, the first conveying section 4*b* includes a first conveyance path 45. The first conveyance path 45 is a sheet conveyance path constituted by a conveying guide. The first conveying section 4*b* further includes a first conveying unit 46.

In the print job, the first roller pairs 43 rotate to convey the sheets along the first conveyance path 45. The sheets conveyed by the first roller pairs 43 reach the registration roller pair 44. The registration roller pair 44 corrects skew of the sheets, and then sends out the sheets to the first conveying unit 46.

The first conveying unit 46 includes a conveyor belt 48. The sheets through the registration roller pair 44 are delivered onto the conveyor belt 48. The conveyor belt 48 is looped around belt rollers. In the print job, the conveyor belt 48 circles in conjunction with rotation of the belt rollers. With this, the sheets on the conveyor belt 48 are conveyed. The sheets passes below (on the −Z direction side relative to) the image forming section 4*c*.

The image forming section 4*c* includes a plurality of line heads 47. The image forming section 4*c* includes a line head 47K that ejects a black ink, a line head 47C that ejects a cyan ink, a line head 47M that ejects a magenta ink, and a line head 47Y that ejects a yellow ink. The line heads 47 are arranged above (on the +Z direction side relative to) the first conveying unit 46. The line heads 47 form images onto the sheets on the conveyor belt 48 by respectively ejecting the inks in accordance with the image data for ink ejection.

The second conveying section 4*d* conveys the sheets which have passed through the image forming section 4*c* (sheets on which the images have been formed) to a delivery tray. The second conveying section 4*d* includes a second conveying unit 49 and a plurality of second roller pairs 410. In addition, the second conveying section 4*d* includes a second conveyance path 411. The second conveyance path 411 is a sheet conveyance path constituted by a conveying guide. A decurling section 412 is arranged on the downstream side in the sheet conveying direction relative to the second conveying unit 49.

In the print job, the second conveying unit 49 conveys the sheets, and at the same time dries the ejected inks on the sheets. The decurling section 412 corrects curls of the sheets. The second roller pairs 410 rotate to convey the sheets.

The maintenance unit 102 is arranged below the second conveying unit 49. In maintenance of the ink jet heads 100 (nozzles 5), the first conveying unit 46 retracts, and the maintenance unit 102 moves to below the image forming section 4*c* (line heads 47). Then, after the maintenance has been completed, the maintenance unit 102 retracts, and the first conveying unit 46 moves to its original position.

(Line Heads 47)

Figure 3:
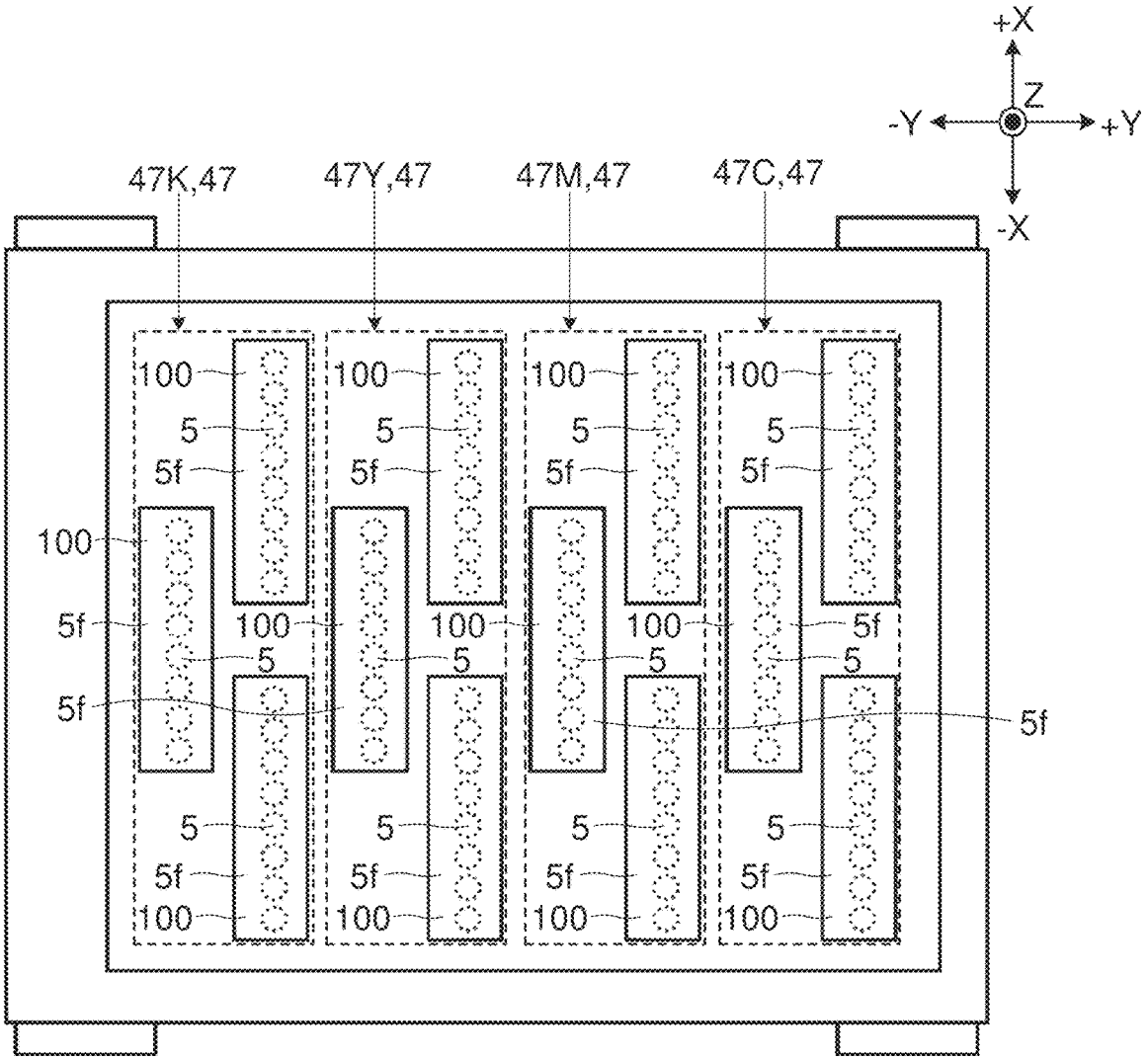
FIG. 3 is a schematic view of line heads constituted by the inkjet heads according to the embodiment.

As shown in FIG. 1 to FIG. 3, the image forming section 4*c* includes the plurality of line heads 47 (47C, 47M, 47Y, and 47K). Note that, FIG. 3 is a view in which the line heads 47 are viewed from below (−Z direction). The line heads 47, which respectively use the inks in the different colors, have the same configuration.

The line heads 47 each include the plurality of ink-jet heads 100. The line heads 47 are each constituted by a combination of the plurality of ink-jet heads 100. For example, the line heads 47 each include three of the ink-jet heads 100. Note that, the line heads 47 may each be constituted by a combination of two of the ink-jet heads 100, or the line heads 47 may each be constituted by a combination of four or more of the ink-jet heads 100.

In each of the line heads 47 illustrated as an example in FIG. 3, among the ink-jet heads 100, three corresponding to the same color are arrayed in the X-axis direction (main scanning direction), two of the three are arranged at the same position in the Y-axis direction (sub-scanning direction), and a remaining one of the three is displaced in the Y-axis direction.

The ink-jet heads 100 each include the plurality of nozzles 5 arrayed in the X-axis direction (main scanning direction). The nozzles 5 have openings through which the inks are ejected. A surface in which the nozzles 5 are formed among surfaces of each of the ink-jet heads 100 serves as an ink ejection surface 5*f*. In FIG. 3, the nozzles 5 are indicated by dotted-line circles. Note that, in FIG. 3, for the sake of convenience, the nozzles 5 are illustrated in a size larger than an actual size of the nozzles 5.

The nozzles 5 are formed in a bottom surface of each of the ink-jet heads 100. With this, the openings of the nozzles 5 are oriented in the −Z direction. Under the state in which the printer 101 is installed in the horizontal plane, the nozzles 5 are oriented downward, and the inks are ejected from top to bottom. The nozzles 5 face the conveyor belt 48 and the sheets on the conveyor belt 48. The ink-jet heads 100 are supported so that a preset clearance (for example, 1 mm) is secured between the nozzles 5 and the conveyor belt 48 or between the nozzles 5 and the sheets on the conveyor belt 48.

(Ink-Jet Heads 100)

Figure 4:
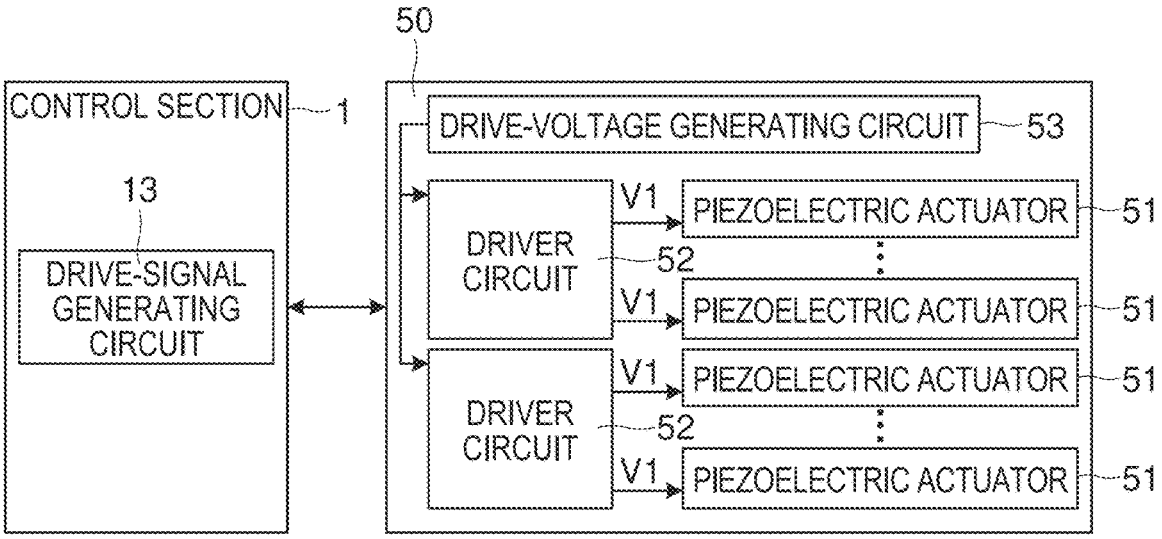
FIG. 4 is a block diagram of the inkjet head according to the embodiment.

As shown in FIG. 4, the ink-jet heads 100 each include a plurality of piezoelectric actuators 51. The piezoelectric actuators 51 are provided one by one to the nozzles 5. The piezoelectric actuators 51 each include a piezoelectric device. The piezoelectric device is, for example, a stack of piezoelectric devices formed in layers in the Z-axis direction. The piezoelectric actuators 51 are deformed by application of drive voltage V1. The nozzles 5 eject the inks by the deformation of corresponding ones of the piezoelectric actuators 51.

The ink-jet heads 100 each include a head substrate 50. The head substrate 50 includes driver circuits 52. The driver circuits 52 turn ON/OFF the application of the voltage to the piezoelectric actuators 51. The control section 1 provides the image data for ink ejection (data indicating through which of the nozzles 5 the inks are to be ejected) to the driver circuits 52.

In accordance with the image data for ink ejection, the driver circuits 52 apply the drive voltage V1 to piezoelectric actuators 51 of nozzles 5 through which the inks are to be ejected among the piezoelectric actuators 51 of the nozzles 5. With this, the piezoelectric actuators 51 of the nozzles 5 through which the inks are to be ejected are deformed. In addition, pressure generated by the deformation of the piezoelectric actuators 51 is applied to individual flow paths 92 described below. In this way, the inks are ejected through the nozzles 5 through which the inks are to be ejected. The driver circuits 52 do not apply the drive voltage V1 to other piezoelectric actuators 51 of other nozzle 5 that do not allow the inks to be ejected among the piezoelectric actuators 51 of the nozzles 5.

The head substrate 50 includes a drive-voltage generating circuit 53. The drive-voltage generating circuit 53 generates the voltage. The drive-voltage generating circuit 53 supplies the voltage to the driver circuits 52. The driver circuits 52 apply the voltage supplied from the drive-voltage generating circuit 53 to the piezoelectric actuators 51 of the nozzles 5 through which the inks are to be ejected.

The control section 1 includes a drive-signal generating circuit 13. The drive-signal generating circuit 13 generates a drive signal. The drive signal is, for example, a clock signal. The drive signal is a signal for causing the inks to be periodically ejected. For example, every time the drive signal rises or falls, the driver circuits 52 causes the inks to be ejected by an amount corresponding to one line. Then, the first conveying section 4*b* conveys the sheet by a distance corresponding to one pixel in one ink-ejection cycle.

Figure 5:
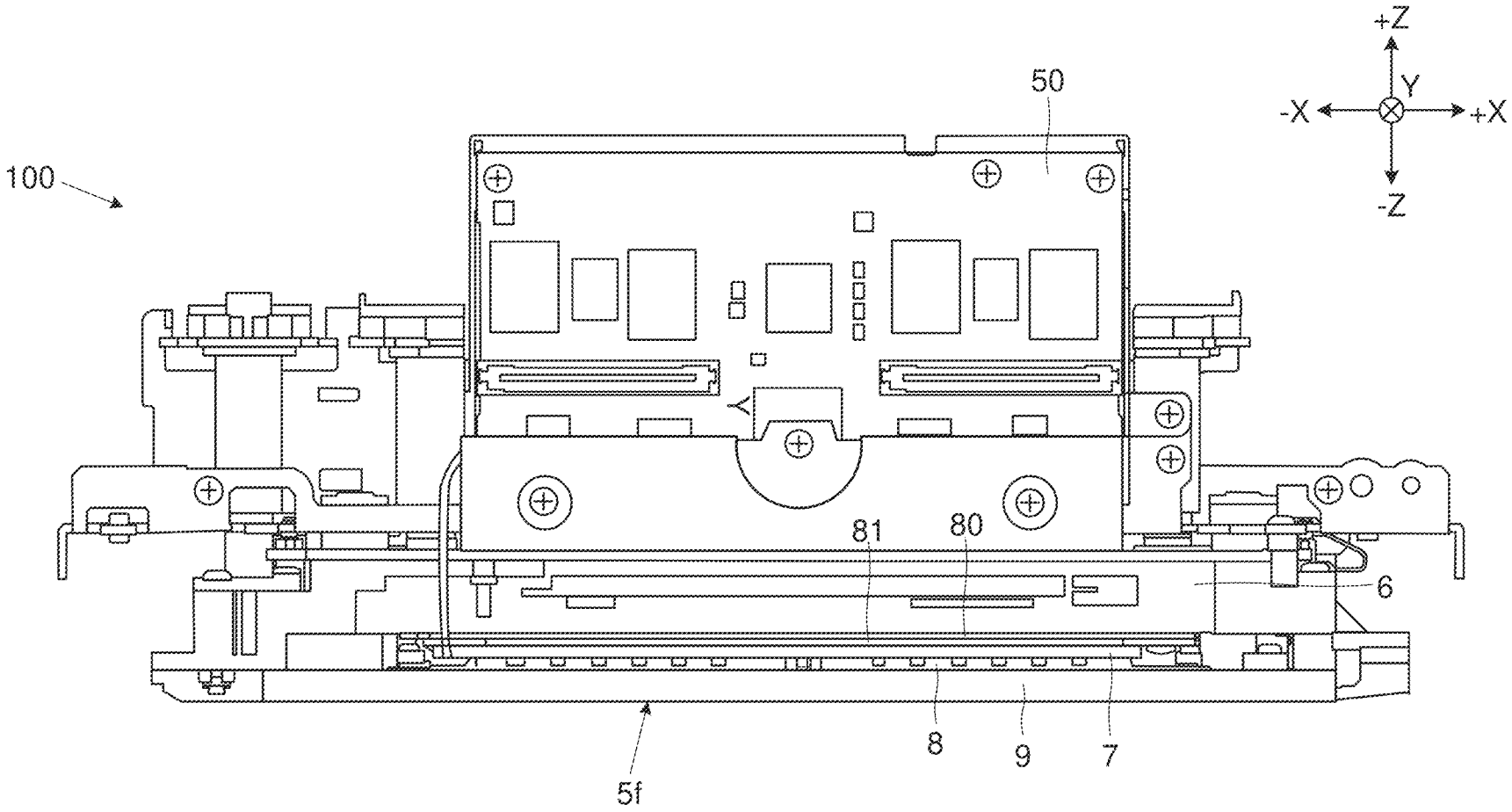
FIG. 5 is a detailed view of the ink-jet head according to the embodiment.
Figure 6:
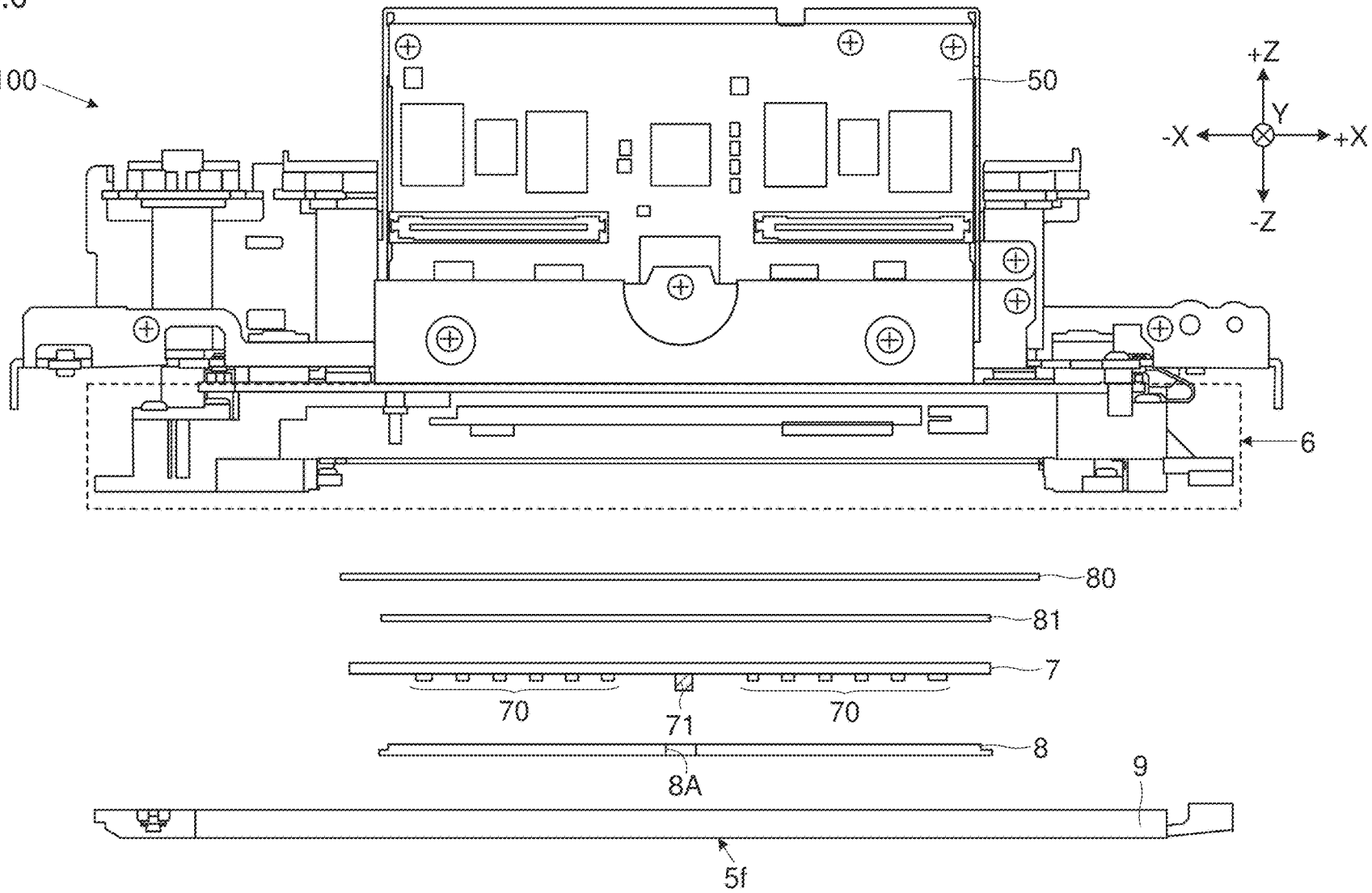
FIG. 6 is a partially exploded view of the ink-jet head illustrated in FIG. 5.

As illustrated in FIG. 5 and FIG. 6, the ink-jet heads 100 each include a back end portion 6 and a front end portion 9. The head substrate 50 is arranged above (on the +Z direction side relative to) the back end portion 6. In FIG. 6, a part surrounded by broken lines is the back end portion 6. Note that, in the illustration of FIG. 6, for the sake of convenience, a part of the ink-jet head 100 is disassembled.

The ink is fed from an ink cartridge (not shown) into the back end portion 6. The back end portion 6 discharges the fed ink. Below (on the −Z direction side relative to) the back end portion 6, a protection plate 80, an adhesive sheet 81, a heating plate 7, a thermally conductive sheet 8, and the front end portion 9 are arranged sequentially from a top (+Z direction side) (refer to FIG. 6).

Figure 7:
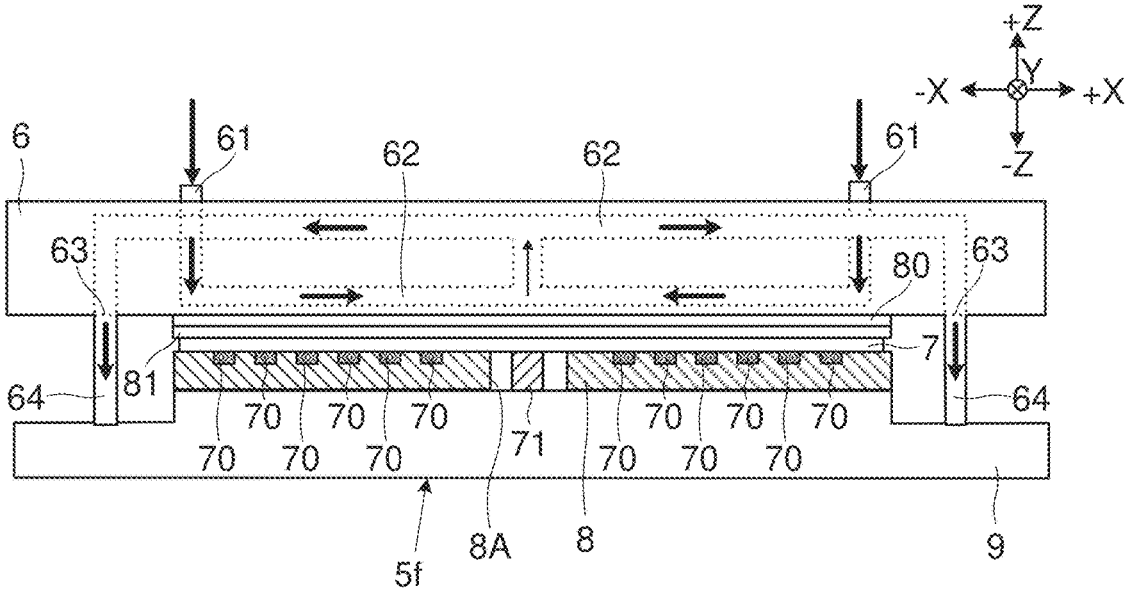
FIG. 7 is a schematic view of the ink-jet head according to the embodiment.

As illustrated in FIG. 7, the back end portion 6 includes ink introduction portions 61 to be connected to the ink cartridge. The ink introduction portions 61 are provided respectively on one side and another side in the X-axis direction (main scanning direction). The back end portion 6 includes therein ink flow paths 62. The ink flow paths 62 are pipes through which the ink flows. The ink to be fed from the ink cartridge into the back end portion 6 enters the ink flow paths 62 through the ink introduction portions 61. In FIG. 7, the ink flow paths 62 are indicated by dotted lines, and directions in which the ink flows are indicated by bold arrows.

The ink having entered the ink flow paths 62 flows in the −Z direction (downward), and then flows to a center in the X-axis direction (main scanning direction). Next, the ink flows in the +Z direction (upward). After that, the ink branches to flow in the +X direction (one side in the main scanning direction) and the −X direction (other side in the main scanning direction) to reach ink discharge ports 63.

The ink discharge ports 63 are connected to the front end portion 9 via ink transport pipes 64. The back end portion 6 discharges the ink through the ink discharge ports 63. The ink to be discharged from the back end portion 6 is supplied to the front end portion 9 through the ink transport pipes 64.

The protection plate 80 is a metal plate having high thermal conductivity. An aluminum plate or a copper plate may be used as the protection plate 80. The protection plate 80 may be attached to the back end portion 6 with screws. The protection plate 80 has a rectangular shape as viewed in the Z-axis direction. A longitudinal direction of the protection plate 80 is the X-axis direction. A transverse direction of the protection plate 80 is the Y-axis direction.

The adhesive sheet 81 is a double-faced tape. The adhesive sheet 81 has a rectangular shape as viewed in the Z-axis direction. A longitudinal direction of the adhesive sheet 81 is the X-axis direction. A transverse direction of the adhesive sheet 81 is the Y-axis direction. The adhesive sheet 81 is applied to a surface on the other side (−Z direction side) among surfaces of the protection plate 80.

The heating plate 7 is a plate-like member. Although not described in detail here, a plurality of heating elements 70 are arranged on a surface on the other side (−Z direction side) among surfaces of the heating plate 7. The heating plate 7 has a rectangular shape as viewed in the Z-axis direction. A longitudinal direction of the heating plate 7 is the X-axis direction. A transverse direction of the heating plate 7 is the Y-axis direction. The adhesive sheet 81 is applied to another surface on the one side (+Z direction side) among the surfaces of the heating plate 7. With this, the heating plate 7 is attached to the hack end portion 6. The heating plate 7 may be attached to the back end portion 6 with screws.

The thermally conductive sheet 8 is a sheet having high thermal conductivity and high elasticity. The thermally conductive sheet 8 has a compression rate of, for example, 50% or more. For example, a sheet made of a silicone-based material may be used as the thermally conductive sheet 8.

The thermally conductive sheet 8 is held in contact with the surface on the other side (−Z direction side) among the surfaces of the heating plate 7. With this, the plurality of heating elements 70 that are arranged on the surface on the other side (−Z direction side) among the surfaces of the heating plate 7 are covered with the thermally conductive sheet 8. The thermally conductive sheet 8 may be a single sheet. In other words, the single thermally conductive sheet 8 may cover all the heating elements 70. Alternatively, the thermally conductive sheet 8 may include a plurality of thermally conductive sheets 8, and the heating elements 70 may include a predetermined number of heating elements 70 that are respectively covered with the plurality of thermally conductive sheets 8.

The front end portion 9 includes the nozzles 5. The ink from the back end portion 6 is supplied to the front end portion 9. The front end portion 9 ejects the ink through the nozzles 5. Note that, the thermally conductive sheet 8 is held in contact with a surface on the one side (+Z direction side) among surfaces of the front end portion 9. Thus, heat is conducted from the heating plate 7 (plurality of heating elements 70) to the front end portion 9 via the thermally conductive sheet 8. With this, the ink in the front end portion 9 (nozzles 5) is heated.

Figure 8:
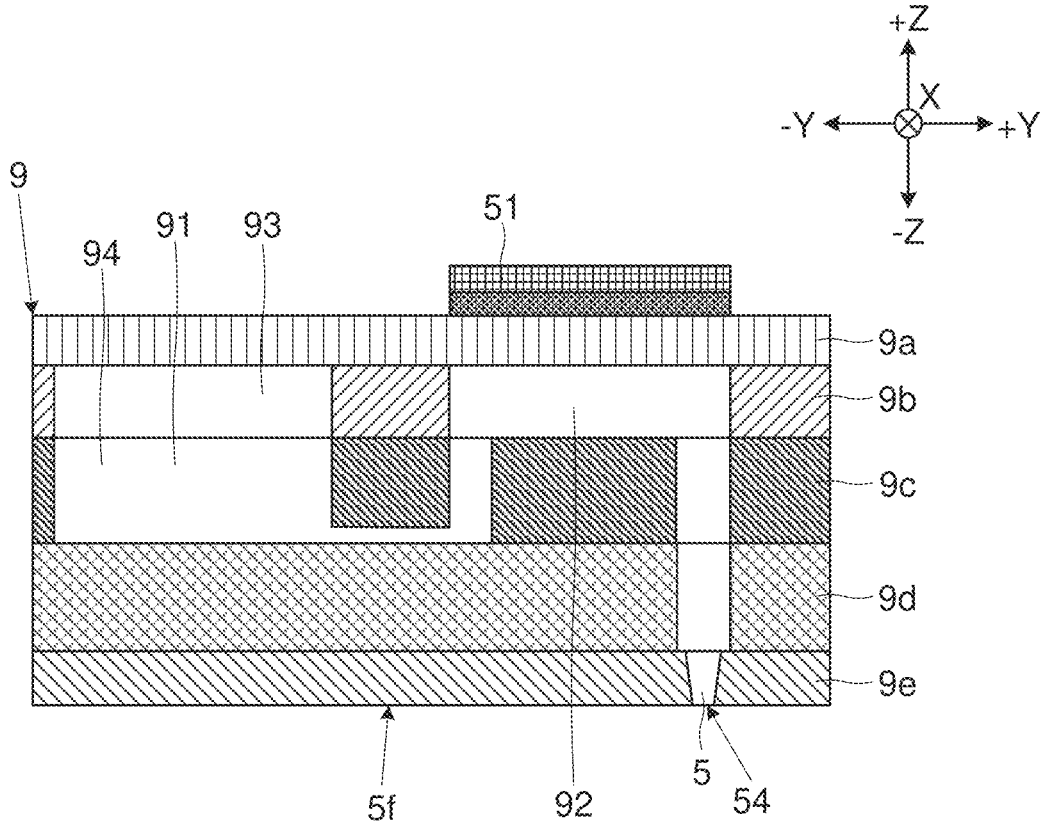
FIG. 8 is a cross-sectional view of a periphery of a nozzle of the inkjet head according to the embodiment.

As illustrated in FIG. 8, the front end portion 9 includes a manifold damper 91 and the individual flow path 92. The manifold damper 91 is a part (space) in which the ink is pooled. The individual flow path 92 is provided one by one to each of the nozzles 5. The nozzles 5 are connected to the manifold damper 91 via corresponding ones of the individual flow paths 92.

The front end portion 9 includes a plurality of stainless metal plates. The plurality of metal plates are stacked in the Z-axis direction. In the following description, for the sake of convenience, these metal plates are respectively referred to as a top plate 9*a*, a first damper plate 9*b*, a second damper plate 9*c*, an individual-flow-path plate 9*d*, and a nozzle plate 9*e* from the +Z direction side to the −Z direction side. This structure (the number of stacked metal plates) of the front end portion 9 illustrated in FIG. 8 is merely an example, and the number of metal plates to be stacked may be increased.

The top plate 9*a* is located in a topmost portion of the front end portion 9. In other words, the top plate 9*a* forms the surface on the one side (+Z direction side) among the surfaces of the front end portion 9. The piezoelectric actuators 51 are provided on (the +Z direction side relative to) the top plate 9*a*.

The first damper plate 9*b* has a first through-hole 93, and the second damper plate 9*c* has a second through-hole 94. The first through-hole 93 and the second through-hole 94 communicate to each other in the Z-axis direction. In addition, the first through-hole 93 and the second through-hole 94 expand in the X-axis direction. A width in the X-axis direction of each of the first through-hole 93 and the second through-hole 94 is equal to or larger than an interval from an outermost one of the nozzles 5 on the −X direction side to another outermost one of the nozzles 5 on the +X direction side (width between a pair of nozzles 5 at both the ends in the X-axis direction).

Under the state in which the first damper plate 9*b* and the second damper plate 9*c* are stacked on each other in the Z-axis direction, respective positions in the Y-axis direction of the first through-hole 93 and the second through-hole 94 align with each other. The top plate 9*a* is arranged on (the +Z direction side relative to) the first damper plate 9*b*. The top plate 9*a* serves as a lid for the part (space) to be formed of the first through-hole 93 and the second through-hole 94. The manifold damper 91 is the part (space) to be formed of the first through-hole 93 and the second through-hole 94. The ink to be discharged from the back end portion 6 to the front end portion 9 is pooled in the manifold damper 91. The nozzles 5 eject the ink to be supplied from the manifold damper 91.

The individual-flow-path plate 9*d* is arranged under (on the −Z direction side relative to) the second damper plate 9*c*. The individual-flow-path plate 9*d* forms the individual flow path 92 cooperatively with the first damper plate 9*b* and the second damper plate 9*c*. In other words, the first damper plate 9*b*, the second damper plate 9*c*, and the individual-flow-path plate 9*d* each have a through-hole to form the individual flow path 92.

The nozzle plate 9*e* is located in a bottommost portion of the front end portion 9. In other words, the nozzle plate 9*e* forms a surface on the other side (−Z direction side) among the surfaces of the front end portion 9. A hole in the Z-axis direction is formed through the nozzle plate 9*e*. This hole part forms an ink ejection port 54 of the nozzle 5.

The through-hole of each of the first damper plate 9*b*, the second damper plate 9*c*, and the individual-flow-path plate 9*d*, the through-hole forming the individual flow path 92, is formed corresponding to each of the nozzles 5. In other words, as viewed in the Z-axis direction, the individual flow paths 92 and wall portions are arrayed alternately to each other.

One of the individual flow paths 92 is connected to a corresponding one of the nozzles 5. In addition, all the individual flow paths 92 are connected to the manifold damper 91. The nozzles 5 receive the ink supplied from the manifold damper 91 through corresponding ones of the individual flow paths 92.

(Heating Plate 7)

Figure 9:
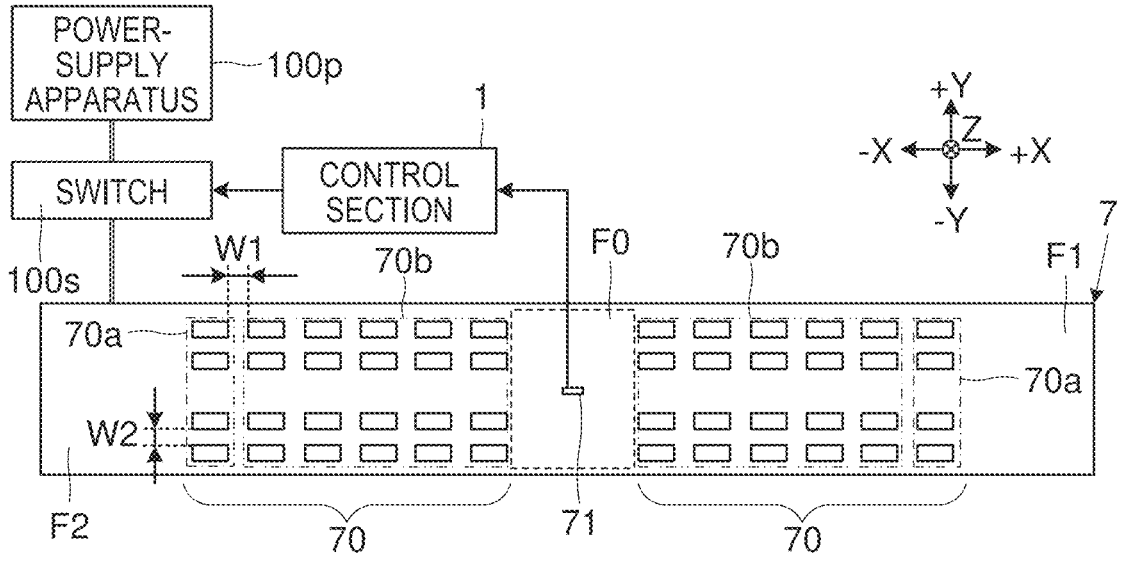
FIG. 9 is a schematic diagram of a heating plate that is installed in the inkjet head according to the embodiment.

As shown in FIG. 9, the heating plate 7 includes the plurality of heating elements 70. The heating plate 7 is the plate-like member on which the plurality of heating elements 70 are arranged. The heating plate 7 is arranged between the back end portion 6 and the front end portion 9 (refer to FIG. 6 and FIG. 7). The plurality of heating elements 70 are arranged on the surface on the other side (−Z direction side) among the surfaces of the heating plate 7. In other words, the surface on which the plurality of heating elements 70 are arranged among the surfaces of the heating plate 7 is a surface to face the front end portion 9.

The heating plate 7 is, for example, a substrate made of a glass epoxy resin. The heating plate 7 is singly provided, and the plurality of heating elements 70 are arranged on this single heating plate 7. The heating elements 70 generate heat by energization. The heating elements 70 are chip resistors. The heating elements 70 need not necessarily be the chip resistors as long as the heating elements 70 are devices that generate heat by energization.

The heating plate 7 shown as an example in FIG. 9 includes forty-eight chip resistors. For example, four chip resistors are arrayed in the Y-axis direction (sub-scanning direction), and twelve chip resistors are arrayed in the X-axis direction (main scanning direction). The number of heating elements 70 is not limited in particular, and may be more than or less than forty eight.

For example, twenty four of the chip resistors on the +Y direction side relative to a center of the Y-axis direction are connected in series, and other twenty four of the chip resistors on the −Y direction side relative to the center of the Y-axis direction are connected in series. In other words, the heating plate 7 includes two resistor circuits in each of which the twenty four of the chip resistors are connected in series.

An isolation region F0 is provided on the lower surface (−Z direction side) of the heating plate 7. The isolation region F0 is a region where the heating elements 70 are not provided. The isolation region F0 is located at a central part in the X-axis direction of the heating plate 7. In FIG. 9, the isolation region F0 is surrounded by broken lines. Note that, although the isolation region F0 shown in FIG. 9 is a rectangular region, the isolation region F0 need not necessarily have a rectangular shape.

In the following description, for the sake of convenience, in a plane where the heating elements 70 of the heating plate 7 are arranged, of a pair of regions sandwiching the isolation region F0 in the X-axis direction, a region on the one side in the X-axis direction (+X direction) is referred to as a first arrangement region F1, and another region on the other side in the X-axis direction (−X direction) is referred to as a second arrangement region F2. For example, in each of the first arrangement region F1 and the second arrangement region F2, the heating elements 70 are arranged in the same number. Note that, the number of heating elements 70 that are arranged in the first arrangement region F1 and the number of heating elements 70 that are arranged in the second arrangement region F2 may differ from each other.

With the heat generated by the plurality of heating elements 70, the heating plate 7 heats the back end portion 6 and the front end portion 9. In other words, the heating plate 7 heats the ink in the back end portion 6 and the ink in the front end portion 9.

Note that, the heating plate 7 (plurality of heating elements 70) is covered with the thermally conductive sheet 8. The thermally conductive sheet 8 is so elastic and compressible as to intrude into gaps between pairs of adjacent ones of the heating elements 70. With this, the heat of the heating plate 7 is efficiently conducted by the thermally conductive sheet 8 in three directions, that is, the X-axis direction, the Y-axis direction, and the Z-axis direction. In addition, a temperature of the heating plate 7 uniformly increases. As a result, an entirety of the front end portion 9 is efficiently heated. Specifically, the ink in the manifold damper 91 and the ink in the nozzles 5 are efficiently heated. Note that, since the temperature of the heating plate 7 uniformly increases, the back end portion 6 is also efficiently heated.

For adjusting the temperature of the ink, the heating plate 7 is provided with a temperature detection device 71. The temperature detection device 71 is, for example, a chip thermistor. The temperature detection device 71 may be a lead thermistor. Note that, the temperature detection device 71 may be temperature measuring devices other than the thermistors.

The temperature detection device 71 outputs values in accordance with a temperature of the front end portion 9. The output values from the temperature detection device 71 are input to the control section 1. On the basis of the output values (output voltage) from the temperature detection device 71, the control section 1 recognizes the temperature of the front end portion 9. Then, in accordance with the temperature of the front end portion 9, the control section 1 controls power supply to the heating plate 7 (plurality of heating elements 70).

The heating plate 7 is connected to a power-supply apparatus 100*p* via an electric line for the power supply (supply line). A switch 100*s* is provided in the supply line. The control section 1 controls ON/OFF of the switch 100*s*. In order to supply the power to the heating plate 7 (in order to heat the ink), the control section 1 turns ON the switch 100*s*. With this, current flows through the heating elements 70 to cause the heating elements 70 to generate heat. In order to stop the power supply to the heating plate 7 (in order not to heat the ink), the control section 1 turns OFF the switch 100*s*.

The temperature detection device 71 is arranged in the isolation region F0. Note that, the temperature detection device 71 may be or need not necessarily be arranged at a position of a center of the isolation region F0 as viewed in the Z-axis direction. For example, the temperature detection device 71 is arranged so that the center of the isolation region F0 and a center of the temperature detection device 71 align with each other as viewed in the Z-axis direction.

An interval in the X-axis direction between heating elements 70 that are closest to the isolation region F0 among the heating elements 70, and the temperature detection device 71 is larger than a first interval W1 and a second interval W2. The first interval W1 is a smallest interval in the X-axis direction between the heating elements 70 (chip resistors) in the first arrangement region F1 and the second arrangement region F2. The second interval W2 is a smallest interval in the Y-axis direction between the heating elements 70 (chip resistors) in the first arrangement region F1 and the second arrangement region F2. By setting the interval in the X-axis direction between the heating elements 70 that are closest to the isolation region F0, and the temperature detection device 71 to be larger than the first interval W1 and the second interval W2, the temperature detection device 71 is prevented from being influenced by the heat from the heating elements 70.

For example, the position in an X-Y plane at which the temperature detection device 71 is arranged may be set on the basis of an interval between the temperature detection device 71 and the heating elements 70 at which there is no temperature difference between an actual temperature of the front end portion 9 and the temperature based on the output value from the temperature detection device 71, or at which an absolute value of the temperature difference is equal to or less than a reference value, the interval being calculated through experiments. Alternatively, an imaginary circle having a radius being a distance at which an amount of heat to be conducted from the heating elements 70 is equal to or less than a preset value, may be set in the X-Y plane, the distance being calculated on the basis of thermal conductivity of the material of the heating plate 7. The temperature detection device 71 may be arranged at a position of a center of the circle, and the heating elements 70 may be arranged at positions on an outside of the circle.

Note that, the heat of the heating plate 7 is dissipated from both ends in the X-axis direction into the air or to other members. Thus, if the power supply to the heating elements 70 is stopped, temperatures at both the ends in the X-axis direction of the heating plate 7 are more likely to decrease than temperatures between the pairs of the adjacent ones of the heating elements 70 decrease. As a countermeasure, in the X-axis direction, an amount of heat to be generated by outermost ones of the heating elements 70 (first heating elements 70*a*) may be set to be larger than an amount of heat to be generated by other ones of the heating elements 70 (second heating elements 70*b*) on an inner side relative to the first heating elements 70*a*. For example, if a small resistance value is set, current increases to cause an increase in amount of heat to be generated. Thus, resistance values of the first heating elements 70*a* may be set to be smaller than resistance values of the second heating elements 70*b*.

Note that, as illustrated in FIG. 7, the temperature detection device 71 is held in direct contact with the surface on the one side (+Z direction side) among the surfaces of the front end portion 9. In other words, the thermally conductive sheet 8 is absent in the Z-axis direction between the temperature detection device 71 and the front end portion 9. In still other words, the temperature detection device 71 is held in direct contact with the front end portion 9 through the thermally conductive sheet 8 in the Z-axis direction.

In order that the temperature detection device 71 is held in direct contact with the front end portion 9, an insertion hole 8A is preformed through the thermally conductive sheet 8. The insertion hole 8A is a hole through the thermally conductive sheet 8 in the Z-axis direction (direction in which the back end portion 6 and the front end portion 9 face each other). In addition, the temperature detection device 71 is inserted into the insertion hole 8A. In other words, the temperature detection device 71 is arranged in the insertion hole 8A.

A shape of an opening (shape as viewed in the Z-axis direction) and a width of the opening (width in a direction orthogonal to the Z-axis direction) of the insertion hole 8A are not limited in particular. The opening of the insertion hole 8A may have a substantially circular shape, or may have other shapes. In addition, the width of the opening of the insertion hole 8A is changed as appropriate in accordance with a width in the direction orthogonal to the Z-axis direction of the temperature detection device 71.

For example, the width in the direction orthogonal to the Z-axis direction of the opening of the insertion hole 8A is larger than a maximum width in the direction orthogonal to the Z-axis direction of the temperature detection device 71. Then, the temperature detection device 71 is inserted into the insertion hole 8A without coming into contact with the thermally conductive sheet 8. In other words, the temperature detection device 71 is not held in contact with an inner peripheral surface of the insertion hole 8A. Note that, as long as the temperature detection device 71 is held in direct contact with the front end portion 9, the temperature detection device 71 and the thermally conductive sheet 8 may be partially held in contact with each other.

In addition, the temperature detection device 71 protrudes to the front end portion 9 than the heating elements 70 protrude. In other words, a distance from a mount surface of the substrate as the heating plate 7 to a distal end (outermost end in the −Z direction) of the temperature detection device 71 is larger than a distance from the mount surface of the substrate as the heating plate 7 to distal ends (outermost ends in the −Z direction) of the heating elements 70. For example, by using the lead thermistor as the temperature detection device 71, the temperature detection device 71 can be easily protruded to the front end portion 9 than the heating elements 70 are protruded.

By protruding the temperature detection device 71 to the front end portion 9 than the heating elements 70 are protruded, even under the state in which the temperature detection device 71 is held in direct contact with the front end portion 9, the heating elements 70 are not held in direct contact with the front end portion 9. Gap are formed in the Z-axis direction between the heating elements 70 and the front end portion 9. The thermally conductive sheet 8 intrudes into the gaps. In other words, the thermally conductive sheet 8 includes parts that are arranged between the heating elements 70 and the front end portion 9.

(Ink Temperature Adjustment)

The control section 1 controls the power supply to the heating plate 7 (plurality of heating elements 70). In other words, the control section 1 controls the temperature of the heating plate 7. With this, the control section 1 adjusts the temperature of the ink. Note that, the printer 101 includes the plurality of ink-jet heads 100. The plurality of ink-jet heads 100 each include the heating plate 7. The control section 1 controls the power supply to the heating plate 7 of each of the plurality of ink-jet heads 100 so as to adjust the temperatures of the inks. The control section 1 executes a procedure shown in FIG. 10 with respect to each of the plurality of ink-jet heads 100.

Figure 10:
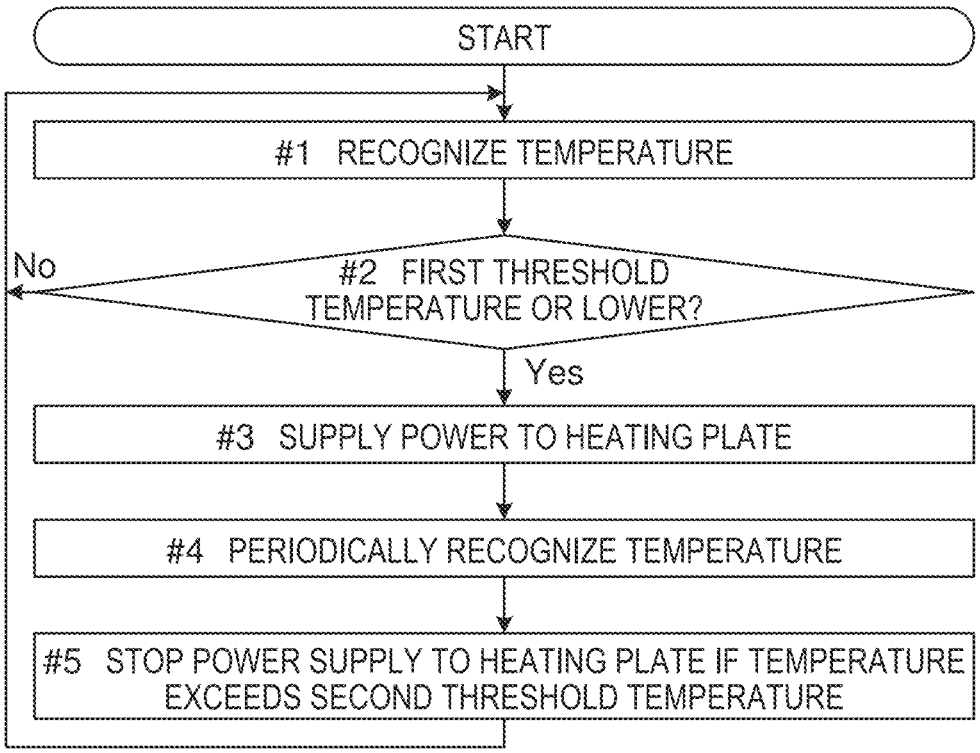
FIG. 10 is a flowchart of a procedure for adjusting a temperature of the ink-jet head according to the embodiment.

The "START" of the procedure shown in FIG. 10 is a time when the ink temperature adjustment is started. Note that, the ink temperature adjustment may be started when main power supply of the printer 101 is turned on and activation of the printer 101 is completed. Alternatively, the ink temperature adjustment may be started when the operation panel 3 accepts an instruction to perform the ink temperature adjustment. Still alternatively, the ink temperature adjustment may be started when a power saving mode of the printer 101 is released. Yet alternatively, the ink temperature adjustment may be started when the communication circuit section 12 receives data of the print job.

In addition, a time point of ending the procedure shown in FIG. 10 is preset. The end time point may be a time point when the main power supply of the printer 101 is turned off. Alternatively, the end time point may be a time point when the operation panel 3 accepts an end instruction. Still alternatively, the end time point may be a time point when a condition of starting the power saving mode of the printer 101 is satisfied, that is, a time point when the power saying mode of the printer 101 is started. Yet alternatively, the end time point may be a time point when the print job is completed.

First, the control section 1 recognizes the temperature of the front end portion 9 on the basis of the output from the temperature detection device 71 (Step #1). Then, the control section 1 checks whether or not the recognized temperature of the front end portion 9 is equal to or lower than a first threshold temperature (Step #2). The first threshold temperature is preset. The first threshold temperature is a temperature within a holding temperature range. The holding temperature range is an ink temperature range to be maintained so that the ink is appropriately ejected. The holding temperature range is preset in accordance with materials of the ink. The first threshold temperature may be a lowest temperature of the holding temperature range. For example, when the holding temperature range is 20° C. to 35° C., the first threshold temperature is 20° C.

If the recognized temperature of the front end portion 9 has exceeded the first threshold temperature (No in Step #2), the control section 1 performs Step #1 (returns to Step #1), Specifically, when a preset waiting time period elapses after the determination of "No" has been made in Step #2, the control section 1 performs Step #1. In this case, the control section 1 monitors variation in temperature without supplying the power to the heating plate 7.

If the recognized temperature of the front end portion 9 is equal to or lower than the first threshold temperature (Yes in Step #2), the control section 1 supplies the power to the heating plate 7 (Step #3). Specifically, the control section 1 heats the front end portion 9 and the back end portion 6 by causing the current to flow through the heating plate 7. When the heating with the heating plate 7 is continued, the temperature of the front end portion 9 and a temperature of the back end portion 6 continue to increase. In other words, the temperature of the ink continues to increase.

Since the start of the heating with the heating plate 7, the control section 1 periodically recognizes the temperature of the front end portion 9 on the basis of the output from the temperature detection device 71 (Step #4). For example, the control section 1 recognizes the temperature of the front end portion 9 once per second to few seconds.

If the recognized temperature of the front end portion 9 exceeds a second threshold temperature, the control section 1 stops the power supply to the heating plate 7 (Step #5). The second threshold temperature is preset. The second threshold temperature is higher than the first threshold temperature. The second threshold temperature is another temperature within the holding temperature range. The second threshold temperature may be a highest temperature of the holding temperature range. After Step #5, the control section 1 performs Step #1 (returns to Step #1).

When the control section 1 executes the procedure shown in FIG. 10, the internal temperatures of the nozzles 5 are maintained at appropriate temperatures.

As described above, in this embodiment, the entirety of the front end portion 9 is heated by the heat generated by the plurality of heating elements 70 arranged on the heating plate 7. In other words, an entirety of the ink in the front end portion 9 can be heated. Thus, temperatures of the ink in the nozzles 5 are equalized, and hence temperature differences between these temperatures of the ink before the ejection through the nozzles 5 decrease. As a result, inconvenience that amounts of the ink to be ejected through some of the nozzles 5 are deficient is suppressed.

Note that, in this embodiment, on the basis of the output values from the temperature detection device 71, the control section 1 recognizes the temperature of the front end portion 9. Then, in accordance with the temperature of the front end portion 9, the control section 1 controls power supply to the heating plate 7. In this configuration, it is preferred that the temperature detection with the temperature detection device 71 be performed with accuracy.

Thus, in this embodiment, the temperature detection device 71 is held in direct contact with the front end portion 9. With this, the temperature of the front end portion 9 (temperatures of the ink in the nozzles 5) can be detected with accuracy. As a result, degradation in image quality due to the ink temperatures can be suppressed.

Note that, the heating plate 7 heats not only the front end portion 9 but also the back end portion 6. With this, before the ink is supplied from the back end portion 6 to the front end portion 9, the ink can be heated also in the back end portion 6 (ink can be preheated). In other words, the ink can be suppressed from being supplied under a low temperature state to the front end portion 9. As a result, even when frequencies of the ejection of the ink differ from nozzle 5 to nozzle 5, the temperature differences between the temperatures of the ink before the ejection through the nozzles 5 do not increase.

Further, since the heating plate 7 is arranged between the front end portion 9 and the back end portion 6, both the front end portion 9 and the back end portion 6 can be heated by the single heating plate 7. With this, manufacturing cost can be suppressed to be lower than that in a case where heaters are provided respectively to the front end portion 9 and the back end portion 6. In addition, spaces necessary for installing these heaters can be saved.

Still further, since the heating plate 7 is formed of the plate-like member, the plurality of heating elements 70 can be arranged on the single heating plate 7. With this, all the nozzles 5 can be heated by the single heating plate 7 (simple structure), and hence a large number of minute heaters need not be provided. As a result, the manufacturing cost can be suppressed.

Yet further, in this embodiment, the thermally conductive sheet 8 is arranged between the heating plate 7 and the front end portion 9. The thermally conductive sheet 8 conducts the heat of the plurality of heating elements 70 to an entirety of the heating plate 7. Thus, the temperature of the heating plate 7 is equalized. In other words, the temperature of the heating plate 7 is gently distributed. With this, the entirety of the front end portion 9 to be held in contact with the heating plate 7 via the thermally conductive sheet 8 can be uniformly heated.

In this configuration, the temperature detection device 71 is held in direct contact with the front end portion 9 through the thermally conductive sheet 8. With this, the entirety of the front end portion 9 can be uniformly heated, and the temperature of the front end portion 9 can be detected with accuracy.

Further, in this embodiment, the thermally conductive sheet 8 has the insertion hole 8A, and the temperature detection device 71 is inserted into this insertion hole 8A. With this, the temperature detection device 71 can be easily held in direct contact with the front end portion 9.

Still further, in this embodiment, the temperature detection device 71 is inserted into the insertion hole 8A without coming into contact with the thermally conductive sheet 8. With this, the accuracy in detecting the temperature of the front end portion 9 with use of the temperature detection device 71 can be increased.

Yet further, in this embodiment, the temperature detection device 71 protrudes to the front end portion 9 than the heating elements 70 protrude. With this, under the state in which the temperature detection device 71 is held in direct contact with the front end portion 9, the gaps are formed between the heating elements 70 and the front end portion 9, and the thermally conductive sheet 8 can be arranged in these gaps. In this way, efficiency in conducting the heat of the plurality of heating elements 70 to the entirety of the heating plate 7 can be increased.

The scope of the present disclosure is not limited to the above-described embodiment of the present disclosure, and may be embodied with various modifications without departing from the gist of the present disclosure.

What is claimed is:

1. An ink-jet head, comprising:
- a back end portion into which an ink is fed;
- a front end portion
  - which includes a nozzle,
  - to which the ink is supplied from the back end portion, and
  - which ejects the ink through the nozzle;
- a heating plate
  - which is a plate-like member on which a heating element that generates heat by energization is arranged,
  - which is arranged between the back end portion and the front end portion, and
  - which heats the back end portion and the front end portion with the heat generated by the heating element; and
- a temperature detection device
  - which is provided on the heating plate, and
  - which outputs a value in accordance with a temperature of the front end portion,
- the temperature detection device being held in direct contact with the front end portion.

2. The ink-jet head according to claim 1, further comprising
- a thermally conductive sheet which is arranged between the heating plate and the front end portion,
- wherein the temperature detection device is held in direct contact with the front end portion through the thermally conductive sheet.

3. The ink-jet head according to claim 2,
- wherein the thermally conductive sheet has an insertion hole which is formed through the thermally conductive sheet in a direction in which the back end portion and the front end portion face each other, and
- wherein the temperature detection device is inserted into the insertion hole.

4. The ink-jet head according to claim 3,
- wherein the temperature detection device is inserted into the insertion hole without coming into contact with the thermally conductive sheet.

5. The ink-jet head according to claim 2,
- wherein the temperature detection device protrudes to the front end portion than the heating element protrudes, and
- wherein the thermally conductive sheet includes a part which is arranged between the heating element and the front end portion.

6. The ink-jet head according to claim 1, further comprising a control section which recognizes the temperature of the front end portion, and which controls power supply to the heating plate, wherein the control section recognizes the temperature of the front end portion on a basis of the output value from the temperature detection device.

* * * * *